US012428933B1

(12) United States Patent
Smith et al.

(10) Patent No.: US 12,428,933 B1
(45) Date of Patent: Sep. 30, 2025

(54) CLEAN UP AND ACTUATION TOOL, METHOD, AND SYSTEM

(71) Applicant: Baker Hughes Oilfield Operations LLC, Houston, TX (US)

(72) Inventors: James Smith, Manvel, TX (US); Wilfred Provost, Tomball, TX (US); Benjamin Farrar, Cypress, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/618,270

(22) Filed: Mar. 27, 2024

(51) Int. Cl.
*E21B 37/04* (2006.01)

(52) U.S. Cl.
CPC ..... *E21B 37/04* (2013.01)

(58) Field of Classification Search
CPC ..... E21B 37/00; E21B 37/02; E21B 37/04; E21B 37/10; E21B 27/005
See application file for complete search history.

(56) References Cited

U.S. PATENT DOCUMENTS

2004/0112588 A1* 6/2004 Mullins ..... E21B 21/103 166/177.3
2010/0258293 A1* 10/2010 Lynde ..... E21B 23/00 166/66.4
2010/0258296 A1* 10/2010 Lynde ..... E21B 37/00 166/105.1
2010/0258297 A1* 10/2010 Lynde ..... E21B 37/00 166/105.1
2012/0118571 A1* 5/2012 Zhou ..... E21B 31/08 166/99
2018/0135372 A1* 5/2018 DeGeare ..... E21B 33/134
2020/0131874 A1* 4/2020 Cajiles ..... E21B 33/12
2021/0372214 A1* 12/2021 Alarfaj ..... E21B 27/005

* cited by examiner

*Primary Examiner* — David Carroll

(74) *Attorney, Agent, or Firm* — Baker Hughes Patent Organization

(57) ABSTRACT

A well cleanup and actuation tool including a cleanup portion of the tool configured to direct flowing fluid into an annular space radially outwardly of the tool and in a downhole direction, while accepting return fluid and entrained debris through a pathway therein, an actuation configuration connected to the cleanup portion, the actuation configuration comprising a profile thereon and a flow passage that bypasses the profile. A method for cleaning and actuating in a borehole, including conveying fluid through the tool, cleaning a target area with the fluid, and bypassing the profile of the actuation section of the tool with the fluid. A wellbore system, including a borehole in a subsurface formation, a string in the borehole, and a cleanup and actuation tool disposed within or as a part of the string.

20 Claims, 6 Drawing Sheets

CLEAN UP AND ACTUATION TOOL, METHOD, AND SYSTEM

BACKGROUND

In the resource recovery and fluid sequestration industries significant cost is associated with runs in the borehole. Reduction of the cost can be achieved with combinations of actions undertaken in a single run. While much effort has been expended in the pursuit of reducing the number of runs, some operations have remained independent and therefore costly.

SUMMARY

An embodiment of a well cleanup and actuation tool including a cleanup portion of the tool configured to direct flowing fluid into an annular space radially outwardly of the tool and in a downhole direction, while accepting return fluid and entrained debris through a pathway therein, an actuation configuration connected to the cleanup portion, the actuation configuration comprising a profile thereon and a flow passage that bypasses the profile.

An embodiment of a method for cleaning and actuating in a borehole, including conveying fluid through the tool, cleaning a target area with the fluid, and bypassing the profile of the actuation section of the tool with the fluid.

An embodiment of a wellbore system, including a borehole in a subsurface formation, a string in the borehole, and a cleanup and actuation tool disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
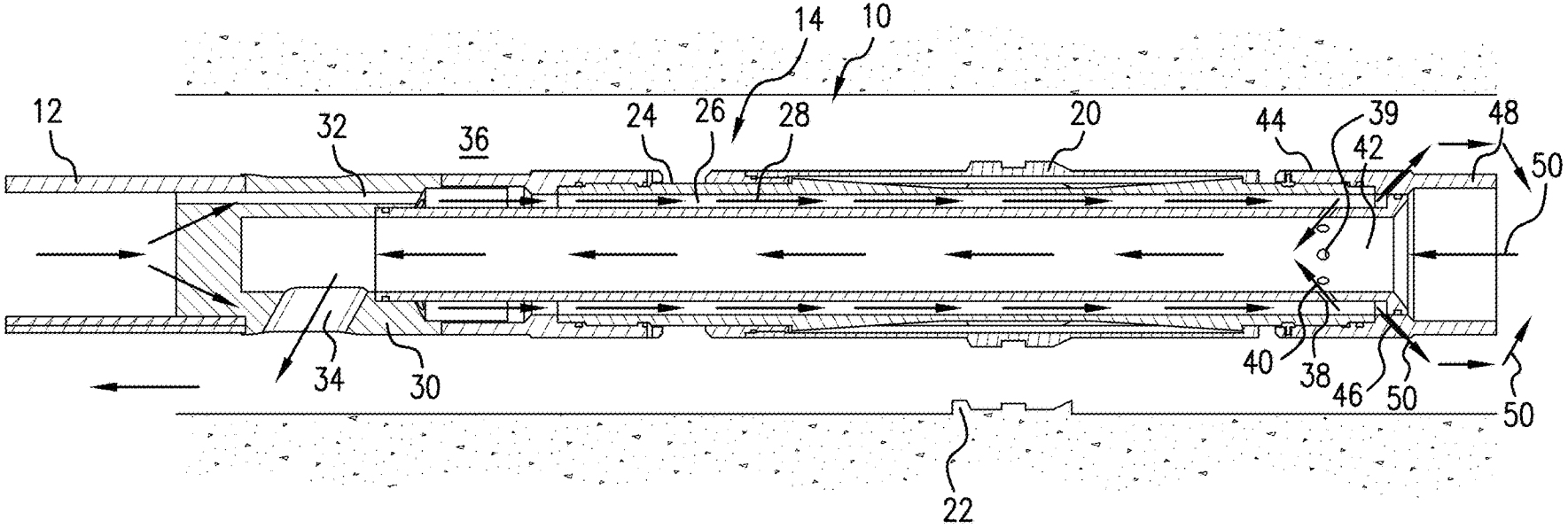
FIG. 1 is a sectional view of a well cleanup and actuation tool as disclosed herein.

Referring to FIG. 1, a sectional view of a well cleanup and actuation tool 10 is illustrated along with arrows that indicate a fluid flow direction through the tool 10, during use. The tool 10 comprises a cleanup section 12 and an actuation section 14 that both conveys the fluid passing through the cleanup section 12 and operates to actuate something in the downhole environment. The cleanup section may be any commercially available fluid flow based debris entrainment system used for cleaning boreholes, such as but not limited to the VACS™ borehole cleanup system commercially available from Baker Hughes. The two sections 12 and 14 are attached to each other and to a string at surface and run simultaneously to advantageously clean the borehole and actuate a tool in a single run. In order to successfully accomplish this result it is important that the cleanup fluid not interfere with the actuation profile 20 that is presented on the actuation section 14. Actuation section 14 then is configured, in embodiments, to pass the cleanup fluid to the downhole end of the tool 10 to effect cleanup while avoiding the profile 20.

Continuing with reference to FIG. 1, the first embodiment of actuation section 14 can be appreciated to have a housing 24 within which is a flow area that may be constructed as a plurality of gun drilled holes 26 or could be constructed as an annular space in some embodiments, which would look the same in FIG. 1). Within these holes will be fluid flow that moves in the direction of arrows 28. Feeding the gun drilled holes 26 is fluid that is passed through a crossover sub 30 that itself includes gun drill holes 32. Circumferentially between the gun drilled holes 32 are located cross over ports 34 that lead flowing fluid back to the annulus 36 and back to surface. At a downhole end of housing 24 are venturi ports 38 that turn some of the fluid flow of arrows 28 to an uphole direction arrows 40 and into the return path 42. Due to the angle of the venturi ports 38, a lower pressure is generated in fluid downhole of the venturi ports 38 than uphole thereof. These therefore increase fluid velocity and turbulence. In embodiments, there may also optionally be included a filter 39 to filter fluid flowing through the ports 38. A bottom cap 44 includes openings 46 that direct another portion of the fluid from flow 28 (from the gun drill holes 26) to the annulus 36 and around an end 48 of section 14 to the return path 42. The flow of arrows 50 will entrain debris, introducing it to the return path 42 while the flow of arrows 40 will help increase velocity of fluid flow in the return 42 as well as enhance turbulence in the flow to ensure debris entrainment, maintained suspension, and transport. In this embodiment, the debris is transported to surface. As noted above, the flow of fluid does not impact the profile 20 as relevant flow is maintained radially inwardly of the profile 20. This leaves profile 20 free to engage a radially outwardly positioned complementary profile 22 of a downhole feature (string, casing, tool, etc.) that is to be actuated.

Figure 2:
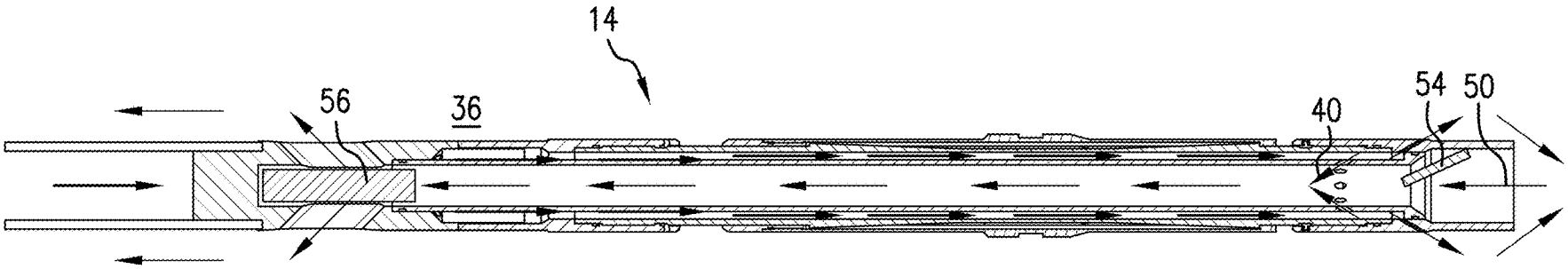
FIG. 2 is a sectional view of another embodiment of the well cleanup and actuation tool as disclosed herein.
Figure 3:
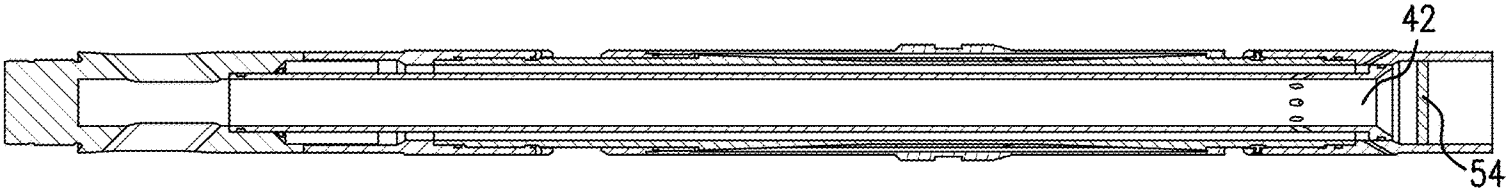
FIG. 3 is the same view as FIG. 2 but without the flow lines depicted.

Referring to FIGS. 2 and 3, an alternate embodiment of the tool 10 is illustrated. As can be ascertained by brief review the embodiment is very similar to that of FIG. 1 but does include two departures that provide benefit to a user. Only these two features need be detailed as the balance of the tool 10 in the embodiment is the same as that of FIG. 1 and hence the discussion above is applicable. The FIG. 2 embodiment includes a flapper 54 that opens from fluid flow entering the return path 42 and will close (FIG. 3) if velocity in flow 50, 40 ebbs. This will prevent entrained debris falling back out of the tool 10 if the flow regime that picked up that debris is reduced in rate or stops. The flapper closing action under such circumstance will be automatic and may be due to gravity if the tool 10 is employed in a vertical borehole or may be due to a torsion spring as is common for use with flappers in the industry, or both. Additionally, the embodiment may also or instead include a filter 56 at an uphole end of the actuation section 14. This filter will prevent debris that is entrained in the fluid from entering the annulus 36 uphole of the section 14 where it would need to be transported to surface. Rather, the filter allow for fluid to flow through but the debris to be trapped in the actuation section 14.

Figure 4:
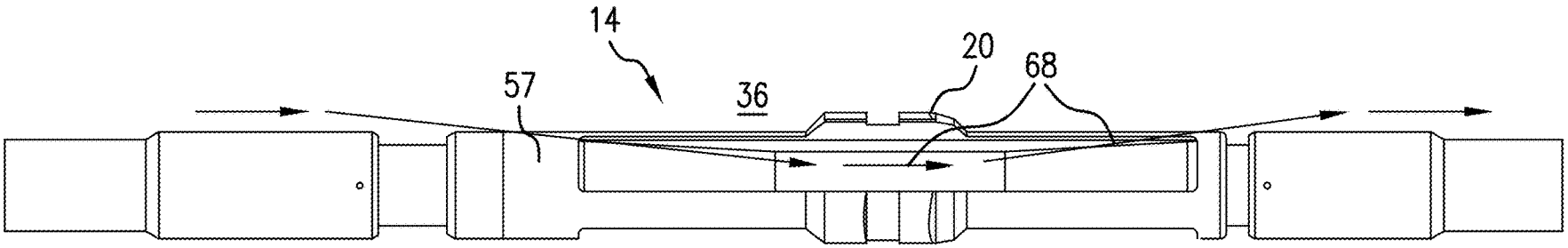
FIG. 4 is a side view of another embodiment of the well cleanup and actuation tool as disclosed herein.
Figure 5:
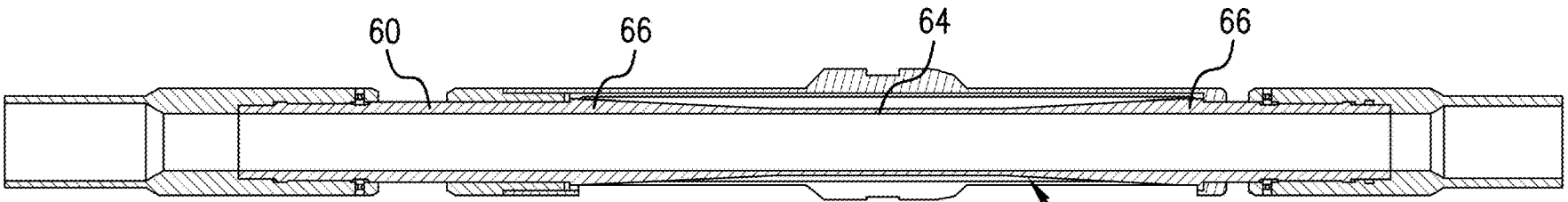
FIG. 5 is a sectional view of FIG. 4.
Figure 6:
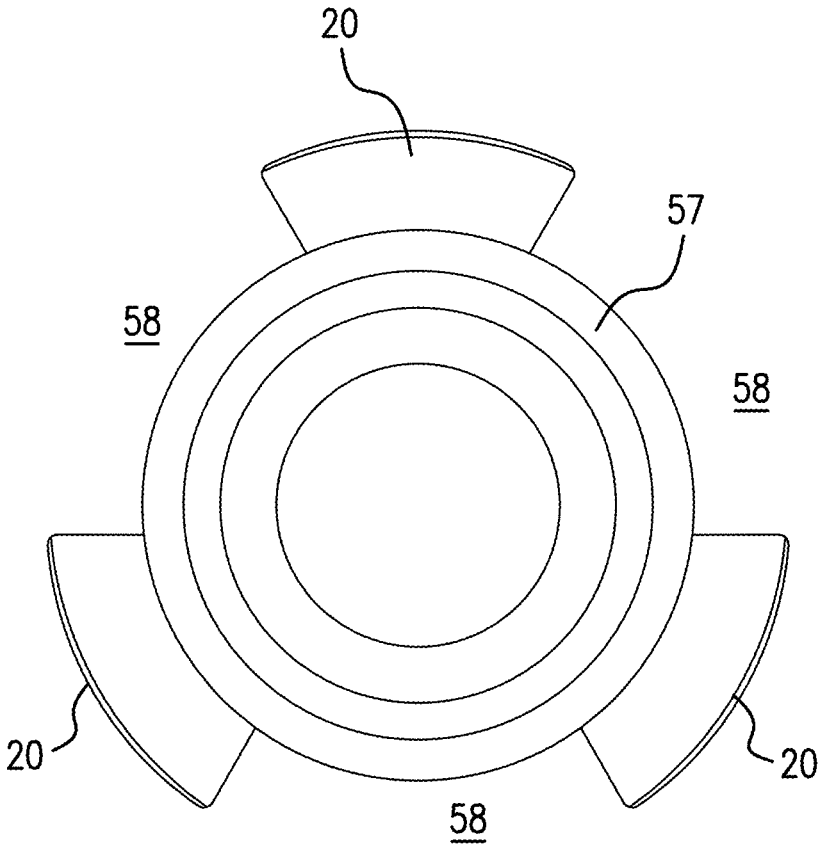
FIG. 6 is an end view of the collet of FIG. 4.

Referring to FIGS. 4-6, another embodiment of section 14 is illustrated. This embodiment does not include gundrills and hence avoids the need to build a housing that has them. Rather this embodiment employs a structure that encourages fluid flowing in the annulus 36 to bypass the profile 20 simply by facilitating a lower resistance pathway. To this end, a collet 57 includes three profiles 20 as illustrated in the end view of FIG. 6. The 3 profiles 20 are spaced apart by about 120 degrees, in the illustrated embodiment (90 degrees, 180 degrees and other number of degrees are also contemplated), and leave open areas 58 between them. Fluid may easily flow in the open areas 58 and will tend to bypass the profiles 20 since fluid will always follow the path of least resistance. Enhancing the likelihood of flow into the open areas 58 is a mandrel 60 that includes in its structure an hourglass type shape 62. Specifically referring to FIG. 5, it can be seen that the mandrel 60 is reduced in cross section at a longitudinal mid point 64 of the shape 62 and is thicker toward its ends 66. This provides for a greater flow area that makes up open areas 58. Arrows 68 in FIG. 4 help to illustrate this flow. At the downhole end of the tool 10 fluid will reverse direction as in the foregoing embodiments, entrain debris and head back to surface in the return path 42.

Figure 7:
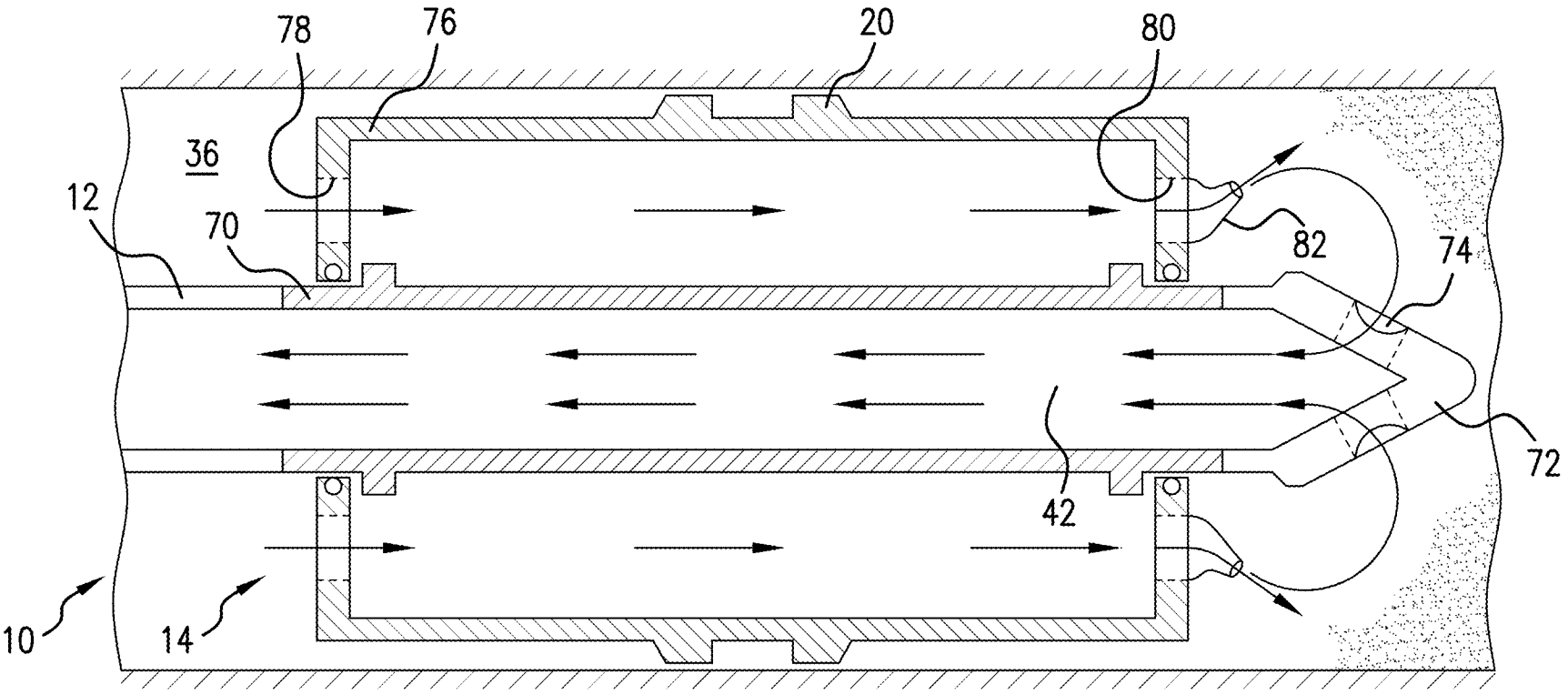
FIG. 7 is a sectional view of another alternate embodiment of the well cleanup and actuation tool disclosed herein.

In yet another embodiment, making reference to FIG. 7, section 14 includes a mandrel 70 having a cap 72. Cap 72 includes openings 74 that are slits or nozzles configured to increase fluid flow velocity and turbulence therethrough as the fluid is entering the return path 42. In this embodiment the profile 20 may be fully circumferentially complete or still may be circumferentially incomplete as desired since the fluid flow in annulus 36 will bypass the profile 20 through a collet 76 that supports the profile 20. More specifically, the collet 76 is configured with an inlet opening 78 and one outlet opening 80, these being located on either longitudinal end of the profile so that fluid may pass under the profile 20. In embodiments, the outlet 80 may also be configured with a nozzle 82 to increase fluid velocity and turbulence. In some embodiments, the nozzle 82 will be angled (illustration indicating one possible angle) to enhance debris entrainment while also increasing fluid velocity and turbulence. This embodiment may also be configured with the flapper and/or the debris filter as illustrated in FIG. 2, if desired.

In each embodiment disclosed, a method for cleanup of a borehole and actuation of a downhole tool in the same run is enabled.

Figure 8:
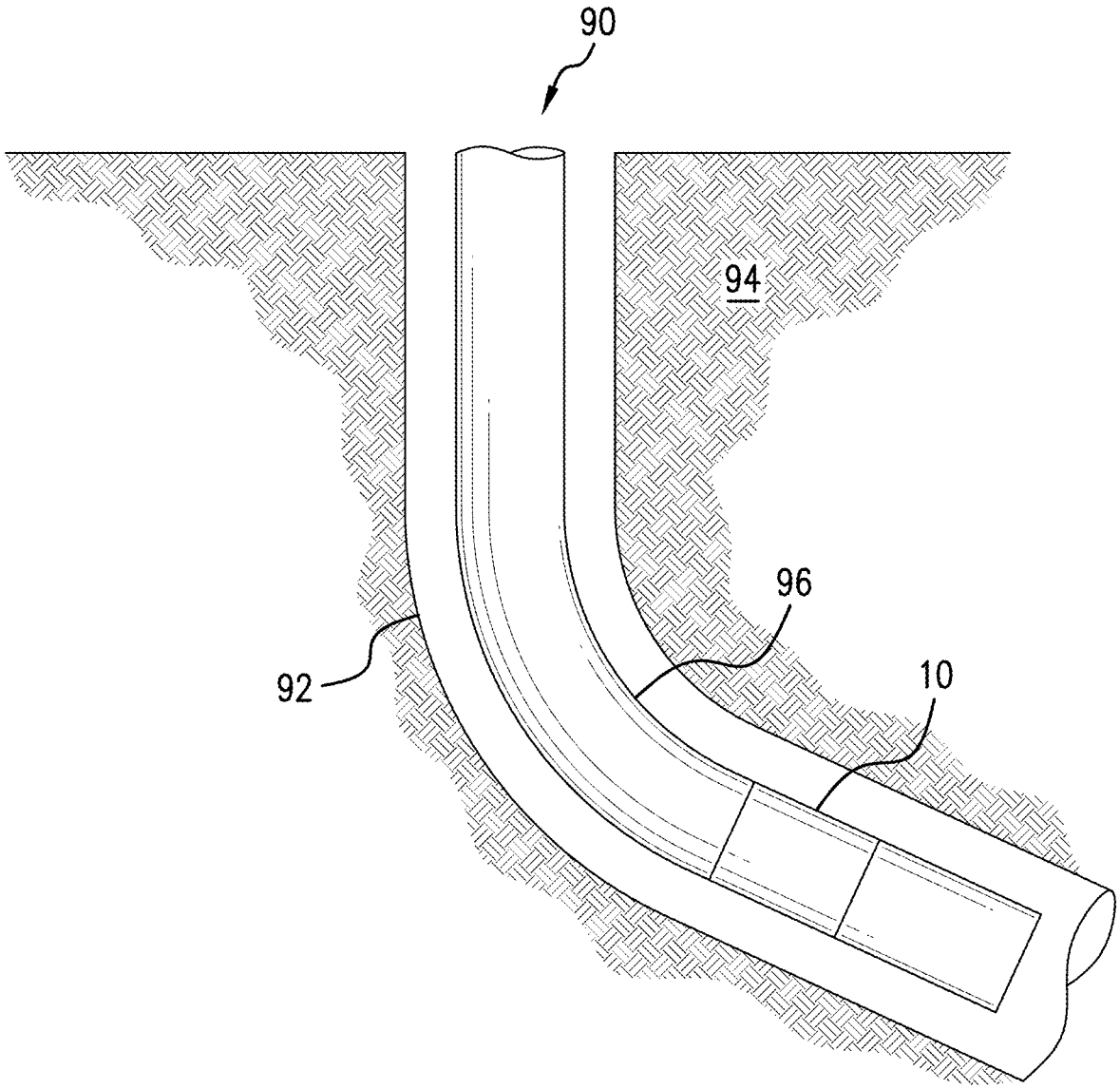
FIG. 8 is a view of a borehole system including the well cleanup and actuation tool as disclosed herein.

Referring to FIG. 8, a borehole system 90 is illustrated. The system 90 comprises a borehole 92 in a subsurface formation 94. A string 96 is disposed within the borehole 92. A well cleanup and actuation tool 10 as disclosed herein is disposed within or as a part of the string 96.

Set forth below are some embodiments of the foregoing disclosure:

Embodiment 1: A well cleanup and actuation tool including a cleanup portion of the tool configured to direct flowing fluid into an annular space radially outwardly of the tool and in a downhole direction, while accepting return fluid and entrained debris through a pathway therein, an actuation configuration connected to the cleanup portion, the actuation configuration comprising a profile thereon and a flow passage that bypasses the profile.

Embodiment 2: The tool as in any prior embodiment, wherein the cleanup portion is a fluid flow based debris entrainment tool.

Embodiment 3: The tool as in any prior embodiment, wherein the actuation configuration includes a standoff housing that supports on a radially outward face thereof the profile.

Embodiment 4: The tool as in any prior embodiment, wherein the housing includes openings therein to form the passage.

Embodiment 5: The tool as in any prior embodiment, wherein the openings are axially oriented.

Embodiment 6: The tool as in any prior embodiment, wherein the housing includes at a downhole end thereof, a nozzle.

Embodiment 7: The tool as in any prior embodiment, wherein the nozzle is configured to direct a jet of fluid radially outwardly of the actuation configuration.

Embodiment 8: The tool as in any prior embodiment, wherein the actuation configuration includes open portions about a circumference thereof.

Embodiment 9: The tool as claimed in any prior embodiment, wherein the profile extends radially from the actuation configuration in specific circumferential positions thereof.

Embodiment 10: The tool as in any prior embodiment, wherein the specific circumferential positions are at 90 degrees, 120 degrees, or 180 degrees from one another.

Embodiment 11: The tool as in any prior embodiment, wherein the actuation configuration includes gun drill holes therein.

Embodiment 12: The tool as in any prior embodiment, wherein one or more of the gun drill holes includes a back angle section to create a venturi action in the actuation configuration that assists in transporting debris entrained fluid, during use.

Embodiment 13: A method for cleaning and actuating in a borehole, including conveying fluid through the tool as in any prior embodiment, cleaning a target area with the fluid, and bypassing the profile of the actuation section of the tool with the fluid.

Embodiment 14: The method as in any prior embodiment, further including causing the fluid to cross over between an inside flow path and an annular flow path.

Embodiment 15: The method as in any prior embodiment, wherein the bypassing is conveying fluid radially inwardly of the profile.

Embodiment 16: The method as in any prior embodiment, wherein the conveying is through a gun drilled passage.

Embodiment 17: The method as in any prior embodiment, wherein the conveying is through a housing.

Embodiment 18: The method as in any prior embodiment, wherein the conveying is circumferentially adjacent the profile.

Embodiment 19: The method as in any prior embodiment, further comprising actuating a feature with the profile.

Embodiment 20: A wellbore system, including a borehole in a subsurface formation, a string in the borehole, and a cleanup and actuation tool as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A well cleanup and actuation tool comprising:

a cleanup portion of the tool configured to direct flowing fluid into an annular space radially outwardly of the tool and in a downhole direction, while accepting return fluid and entrained debris through a pathway therein;

an actuation configuration connected to the cleanup portion, the actuation configuration comprising a profile thereon and a flow passage that bypasses the profile.

2. The tool as claimed in claim 1, wherein the cleanup portion is a fluid flow based debris entrainment tool.

3. The tool as claimed in claim 1, wherein the actuation configuration includes a housing that supports, on a radially outward face thereof the profile.

4. The tool as claimed in claim 3, wherein the housing includes openings therein to form the passage.

5. The tool as claimed in claim 4, wherein the openings are axially oriented.

6. The tool as claimed in claim 3, wherein the housing includes at a downhole end thereof, a nozzle.

7. The tool as claimed in claim 6, wherein the nozzle is configured to direct a jet of fluid radially outwardly of the actuation configuration.

8. The tool as claimed in claim 1, wherein the actuation configuration includes open portions about a circumference thereof.

9. The tool as claimed in claim 1, wherein the profile extends radially from the actuation configuration in specific circumferential positions thereof.

10. The tool as claimed in claim 7, wherein the specific circumferential positions are at 90 degrees, 120 degrees, or 180 degrees from one another.

11. The tool as claimed in claim 1, wherein the actuation configuration includes gun drill holes therein.

12. The tool as claimed in claim 11, wherein one or more of the gun drill holes includes a back angle section to create a venturi action in the actuation configuration that assists in transporting debris entrained fluid, during use.

13. A method for cleaning and actuating in a borehole, comprising:

conveying fluid through the tool as claimed in claim 1;

cleaning a target area with the fluid; and bypassing the profile of the actuation section of the tool with the fluid.

14. The method as claimed in claim 13, further including causing the fluid to cross over between an inside flow path and an annular flow path.

15. The method as claimed in claim 13, wherein the bypassing is conveying fluid radially inwardly of the profile.

16. The method as claimed in claim 15, wherein the conveying is through a gun drilled passage.

17. The method as claimed in claim 13, wherein the conveying is through a housing.

18. The method as claimed in claim 13, wherein the conveying is circumferentially adjacent the profile.

19. The method as claimed in claim 13, further comprising actuating a feature with the profile.

20. A wellbore system, comprising:

a borehole in a subsurface formation;

a string in the borehole; and a cleanup and actuation tool as claimed in claim 1 disposed within or as a part of the string.

* * * * *